US005779447A

United States Patent [19]

Tomita et al.

[11] Patent Number: 5,779,447

[45] Date of Patent: Jul. 14, 1998

[54] TURBINE ROTOR

[75] Inventors: Yasuoki Tomita; Lars Thomsen, both of Takasago, Japan

[73] Assignee: Mitsubishi Heavy Industries, Ltd., Tokyo, Japan

[21] Appl. No.: 800,985

[22] Filed: Feb. 19, 1997

[51] Int. Cl.[6] ..... F04D 29/58

[52] U.S. Cl. ..... 416/97 R

[58] Field of Search ..... 415/115, 116; 416/96 A, 97 R, 95

[56] References Cited

U.S. PATENT DOCUMENTS 5,403,157 4/1995 Moore ..... 415/115

FOREIGN PATENT DOCUMENTS 1087527 10/1980 Japan ..... 416/97 R 135604 7/1985 Japan ..... 416/97 R

*Primary Examiner*—John T. Kwon

*Attorney, Agent, or Firm*—Wenderoth, Lind & Ponack

[57] ABSTRACT

A gas turbine rotor, more particularly a gas turbine rotor blade, which is manufactured so as to be longer, larger, and thin walled and is provided on a rear side of a gas turbine blade array. The gas turbine rotor blade is cooled with cooling air flowing interiorly thereof. A cavity is provided to facilitate the flow of cooling air. The cavity is formed inside a rotor root and inside a hub unit disposed adjacent to a rotor profile unit. Projections are provided inside of the cavity so that the projections, which protrude from an inner wall of the cavity, project into the cooling air flow. Consequently, cooling efficiency of the rotor blade can be improved, and the strength of the portions forming the cavity can be significantly increased. The device also allows the core for cooling to be manufactured and easily set.

6 Claims, 3 Drawing Sheets

TURBINE ROTOR

BACKGROUND OF THE INVENTION

1. Technical Field

This invention relates to a thin walled, long, and large rotor to be installed on a rear side of a gas turbine blade array, more particularly to a gas turbine rotor provided with a cooling structure so that the rotor can be cooled from inside itself with circulating cooling air.

2. Background of the Technology

As high temperature and high output gas turbines are used more and more, the gas turbine rotor installed on a rear side of such a gas turbine blade array (hereinafter referred to as a rotor) has also become longer and larger as shown in FIGS. 4A–B.

Such a long and large rotor 10 itself becomes heavy and the circumferential speed becomes high as the rotor becomes longer, so that the stress generated on the rotor 10 also becomes much higher than preferred due to a centrifugal force generated when the rotor 10 rotates.

Such a rotor 10 is often adapted for a thin walled tapered blade, which has a cross section which tapers off toward the blade edge 16 from the hub 11 provided in adjacent to the root of the blade 12 for reducing the weight thereof. The width of the blade 12 is also reduced in width as it approaches the blade edge 16.

Furthermore, in such a long and large rotor 10, a shroud 17 provided at the blade edge 16 of the rotor 10 becomes an integral shrouded blade (hereafter, to be referred to as ISB) unified with the blade 12 for weight saving at the blade edge 16 where a centrifugal force is significant. The shroud is used for suppressing the vibration of the adjacent rotor 10 to improve the vibration resistance.

With such a long, large, and thin walled rotor 10 used on a rear side of a gas turbine blade array, however, a problem arises in that the creep strength of the rotor is reduced due to the high temperature of the rotor 10 caused by the high temperature and high output properties of the gas turbine, in addition to the result of wall-thinning and tapering of the rotor 10 adopted for avoiding increase of the stress caused by a centrifugal force as mentioned above. In order to avoid deterioration of the creep strength of the rotor 10, a cavity 13 is formed inside the blade 12 in the blade root 19 of the rotor 10 and in a section up to 25% of the length in the axial direction of the blade shaft extended to the blade edge 16 from the hub 11 at a boundary of the blade 12 and the blade root 19 by using a ceramic core when the rotor 10 is molded.

Furthermore, inside the blade 12 in a section between the circumference of the cavity 13 and the blade edge 16 are provided many small holes (multiple holes) 15 in the direction of the blade shaft, so that cooling air supplied from the turbine rotor (not illustrated) is flown into the cavity 13 and is discharged from openings provided at the blade edge 16 or the shroud 17 through the multiple holes 15, as shown with arrows, for cooling the blade 12, the hub unit 18, and the blade root 16 in the rotor 10.

In the figure, the numeral 14 indicates a core supporting rib provided when the rotor 10 is molded to support the ceramic core, which is used for forming the cavity 13 inside the hub unit 18, at the portion where the cavity 13 is to be formed.

A rotor 10 is provided with an interior cooling structure, however, it also has a problem in that it is difficult to manufacture a core for forming the cavity 13 and to set the core inside the rotor 10 in which the cavity 13 is to be provided. Furthermore, in a case of a rotor used for a gas turbine whose inlet temperature reaches about 1500° C., due to high temperature and high pressure properties of the gas turbine, the above mentioned cooling system provided by the cavity 13 in the above hub 18 for improving efficiency and supplying cooling air into the rotor is insufficient, thus causing a serious problem with respect to creep strength.

OBJECTS OF THE INVENTION

The object of the present invention is to solve the problems of the prior art by providing a gas turbine rotor which is long, large, and thin walled, and is also usable for gas turbines having higher inlet temperatures. In order to achieve this object, this invention also makes it easier to manufacture a core for forming a cavity inside the rotor, it is especially easier to manufacture such a core due to easier setting of the core. The present invention includes a cavity for cooling which is easily formed, and furthermore, the rigidity, especially twist rigidity of the rotor portion which forms the cavity is improved. Also, the cooling efficiency of the hub unit is improved significantly.

SUMMARY OF THE INVENTION

In order to achieve the above object of this invention, the rotor is provided with the following configuration; to cool the rotor from inside, projections comprising pin fins protruding from the inner wall of the cavity or pillar-like fins both ends of which are respectively connected to the inner walls of the cavity, which face or oppose each other, are provided in a cavity provided inside both the rotor hub unit and inside the root of the blade respectively. The pin fins or projections comprising pillar-like fins should preferably be provided at least in the cavity provided inside the rotor hub unit.

Consequently, the gas turbine rotor of this invention allows a cavity used for cooling to be formed for improving the strength of both the hub and each blade root where the strength becomes critical, especially for improving the cooling efficiency of the hub unit provided in the cavity, with the accelerated turbulent flow of cooling air, and with the increased heat transmission area in the cavity as a result of providing the projections comprising the pin fins or pillar-like fins, so that the temperature in this portion can be prevented from rising and the creep strength can be further increased due to the compensation achieved by the pin fins or pillar-like fins. Thus, this invention can also apply to higher temperature gas turbines and can extend the creep life thereof. Furthermore, since pin fins or projections comprising pillar-like fins are provided, even a thin walled rotor can allow a ceramic core to be manufactured and set for forming a cavity for cooling.

Furthermore, pin fins or projections comprising pillar-like fins function as a structural material particularly in the hub whose walls are thinned so as to form a cavity, for improving the strength of this portion and the twist rigidity, which is an ISB blade property.

BRIEF DESCRIPTION OF THE DRAWINGS

An embodiment of this invention is illustrated in the accompanying drawings in which.

DETAILED DESCRIPTION OF THE PREFERRED EMBODIMENTS

An embodiment of this invention will be described below with reference to the attached drawings.

Figure 1:
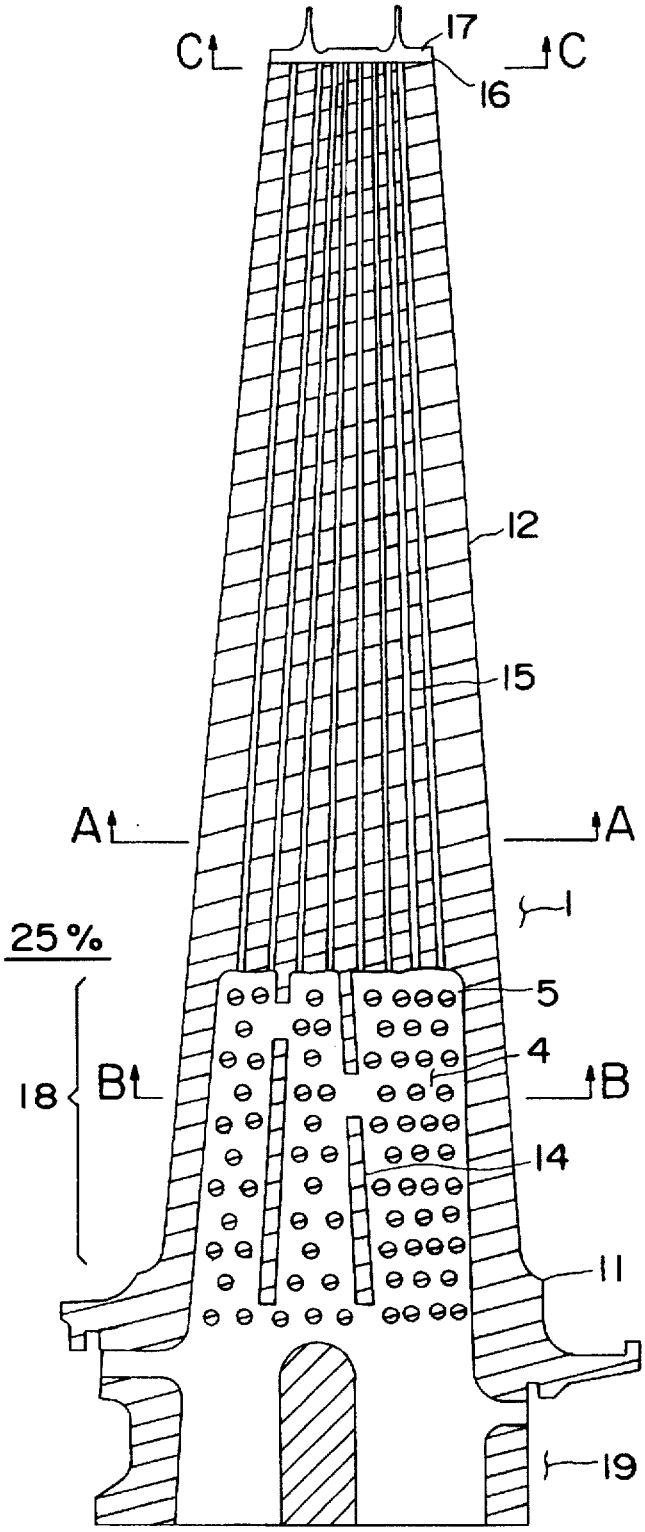
FIG. 1 is a cross sectional view of the center part of a long, large, and thin walled rotor blade in accordance with a first embodiment of this invention. This figure shows a cross section in the blade thickness direction.

As shown in FIG. 1, a cavity 4 having a core supporting rib 14 is provided inside a hub unit 18 of a blade 12 in a section which comprises up to 25% of the blade shaft length in the direction of the blade edge 16 both from the blade root 19 of the long, large, and thin walled rotor 1 and from the hub 11, which is a boundary between the blade root 19 and the blade 12. In cavity 4, pin fins 5 are provided and will be described later. Inside a portion between the outer periphery of the cavity 4 and the blade edge 16 are formed many small holes (multiple holes) 15 extending in a length direction of the blade shaft and arranged in the width direction of the blade 12 as shown by the A—A cross section in FIG. 1, just like in the prior art as described above.

Figure 2A:
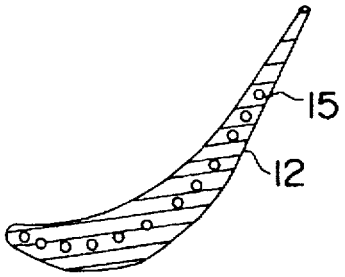
FIG. 2(A) is a cross sectional view taken along the A—A line in FIG. 1.
Figure 2B:
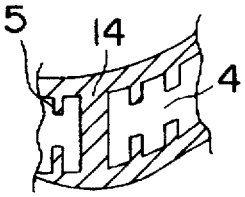
FIG. 2(B) is a cross sectional view taken along the B—B line in FIG. 1.
Figure 2C:
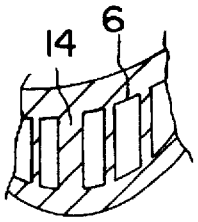
FIG. 2(C) is a cross sectional view taken along the B—B line in FIG. 1 showing a different embodiment from that shown in FIG. 2(B).

Inside the cavity 4 are provided pin fins 5 protruding from an inner wall of the cavity 4 and formed as shown in FIG. 2(B) which is a cross section taken along line B—B as shown in FIG. 1, which is a preferred embodiment of this invention.

The pin fins 5 are 2 mm in diameter and are arranged in 11 lines in the blade shaft direction of the cavity 4 at pitches of 8 to 10 mm in the width direction of the blade shaft.

These pin fins 5 are used to form the cavity 4 and serve to increase the rigidity of the thin-walled hub unit 18. Cooling air is supplied into cavity 4 from a passage provided in the turbine rotor (not illustrated) through multiple holes 15. The cooling air then flows to the blade edge 16. Thus, the cooling efficiency of the hub unit 18 is improved significantly due to both increased cooling area and acceleration of the turbulent air flow caused by the pin fins 5. Also, the creep strength of hub unit 18 is increased.

Since pin fins 5 are provided inside the cavity 4, the ceramic core installed inside the rotor 1 is supported, not only by the core supporting rib 14, but also by the protruding pin fins 5. This makes it easier to manufacture and set the core, since it is no longer necessary to manufacture the core so as to be supported inside the cavity 4.

This invention also allows pillar-like fins 6 to be used instead of the pin fins 5 which protrude from the inner wall of the cavity 4. The pillar-like fins are connected to the inner wall of the cavity 4 from one side to the other side thereof.

When pillar-like fins 6 are provided in the cavity 4, the rigidity of the hub unit 18 is not only further increased with respect to that of the prior art unit which is provided only with the cavity 13, but also the pillar-like fins 6 are more effective for improving rigidity of the hub unit 18 even when compared with the cavity provided with the pin fins 5 as best shown in FIG. 2(B).

Figure 3A:
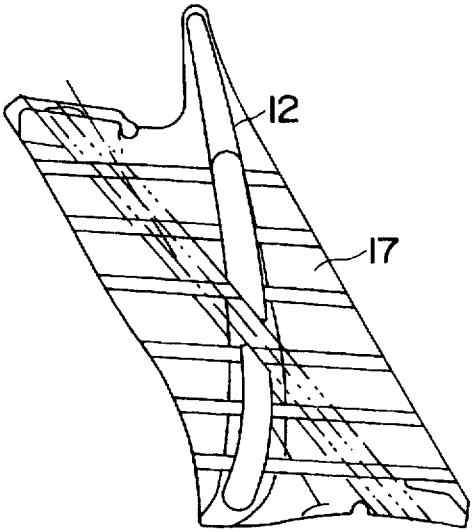
FIG. 3(A) is a top view taken along the C—C line in FIG. 1.

A shroud 17, provided at the blade edge 16 of the gas turbine rotor in this embodiment, should preferably be an air cooling shroud for the cooling air which passes through the multiple holes 15 as shown in FIG. 3.

Figure 3B:
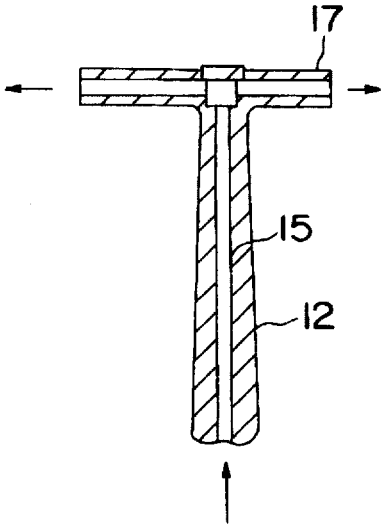
FIG. 3(B) is a cross section view taken along a cooling air passage formed so as to be connected to both a blade and a shroud.
Figure 4A:
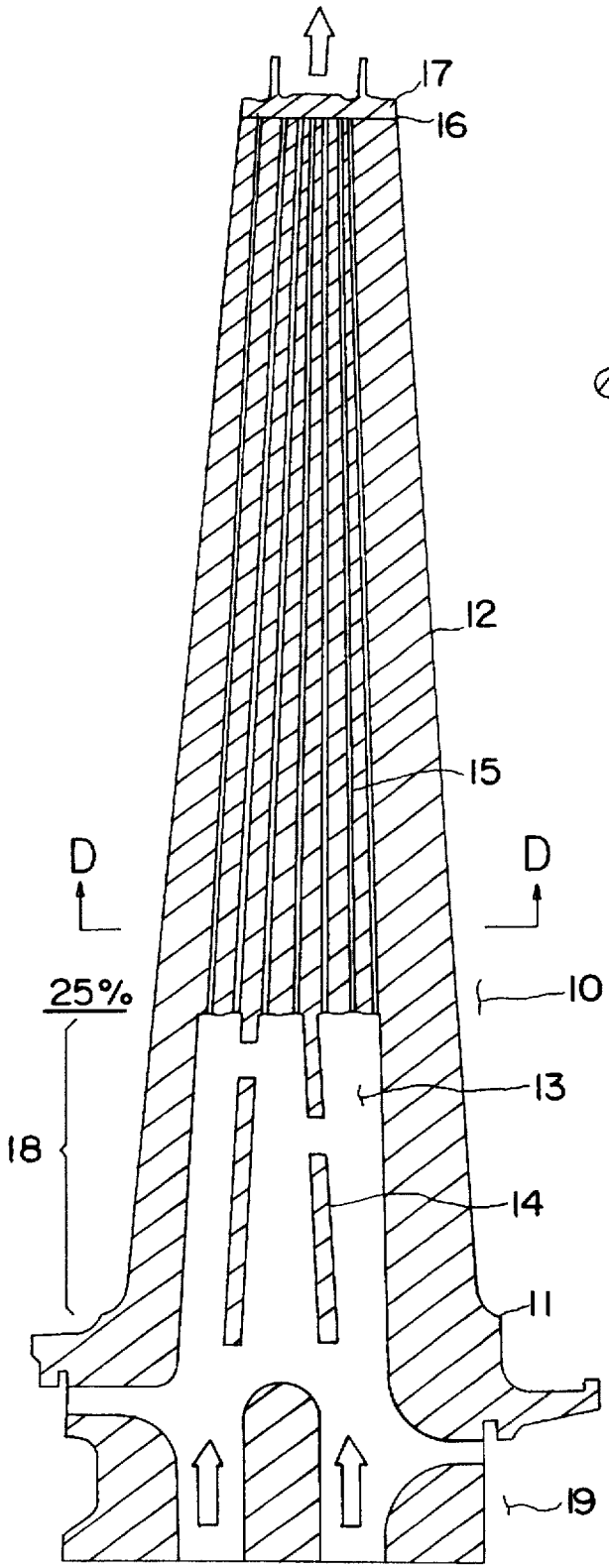
FIG. 4(A) is a cross sectional view of the center part of a prior art rotor as viewed in the blade thickness direction.
Figure 4B:
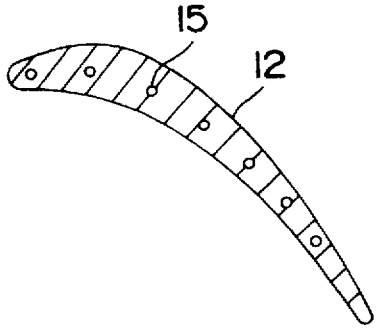
FIG. 4(B) is a cross sectional view taken along the D—D line in FIG. 4(A).

In other words, at the blade edge 16, which is at an outer diameter edge of the blade 12, the shroud 17 is formed so as to be united with the blade 12 as shown in the top view in FIG. 3 (A) in order to prevent the turbine efficiency from being lowered by run-off of the operation liquid from the blade edge 16 or to reduce the vibration of the rotor 1 during rotation. However, if the gas turbine rotor of this embodiment employs an air-cooling shroud, such as the shroud 17, to be cooled from inside with cooling air supplied through the multiple holes 15 inside the blade 12 as shown in FIG. 3(B), which is a cross sectional view taken along the center line of an air passage provided in the outer circumferential direction of the rotor 1 and connected to the multiple holes 15 in the shaft length direction, the cooling effect will be much more improved.

What is claimed is:

1. A turbine rotor blade comprising:

a root portion for affixing said rotor blade to a turbine rotor, wherein said root portion defines a first cooling fluid passageway extending substantially radially through said root portion, and said first cooling passageway has an inlet for receiving a flow of cooling fluid;

a hub unit extending from said root portion, wherein said hub unit defines a plurality of radially extending second cooling fluid passageways which extend through said hub unit, said second cooling fluid passageways are approximately parallel to each other, said second cooling fluid passageways extend from said first cooling fluid passageway so as to be in fluid communication therewith, and said first cooling fluid passageway and said second cooling fluid passageways together define a cavity; and a plurality of pin fins projecting from an inner wall of said cavity, wherein at least a portion of cooling fluid received by said first cooling fluid passageway will flow through said plurality of second cooling fluid passageways.

2. The turbine rotor blade as claimed in claim 1, wherein each of said pin fins includes a tip which projects into said cavity, and said pin fins are arranged along both a width direction and a length direction of said rotor blade.

3. The turbine rotor blade as claimed in claim 1, wherein said pin fins are disposed in a portion of said cavity defined by said second cooling fluid passageways.

4. A turbine rotor blade comprising:

a root portion for affixing said rotor blade to a turbine rotor, wherein said root portion defines a first cooling fluid passageway extending substantially radially through said root portion, and said first cooling passageway has an inlet for receiving a flow of cooling fluid;

a hub unit extending from said root portion, wherein said hub unit defines a plurality of radially extending second cooling fluid passageways which extend through said hub unit, said second cooling fluid passageways are approximately parallel to each other, said second cooling fluid passageways extend from said first cooling fluid passageway so as to be in fluid communication therewith, and said first cooling fluid passageway and said second cooling fluid passageways together define a cavity; and a plurality of projections which comprise pillar-like fins extending across said cavity, wherein at least a portion of cooling fluid received by said first cooling fluid passageway will flow through said plurality of second cooling fluid passageways.

5. The turbine rotor blade as claimed in claim 4, wherein said pillar-like fins extend across said cavity and are arranged in a length direction and a width direction of said rotor blade, and each of said pillar-like fins has opposite ends which are connected to opposing wall portions of said cavity.

6. The turbine rotor blade as claimed in claim 4, wherein said pillar-like fins are disposed in a portion of said cavity defined by said second cooling fluid passageways.

* * * * *